US005735360A

United States Patent [19]

Engstrom

[11] Patent Number: 5,735,360

[45] Date of Patent: Apr. 7, 1998

[54] MINING BIT

[76] Inventor: Robert W. Engstrom, 2209 Foxhill Ave., Gillette, Wyo. 82718

[21] Appl. No.: 746,464

[22] Filed: Nov. 12, 1996

[51] Int. Cl.[6] ..... E21B 10/42

[52] U.S. Cl. ..... 175/391; 175/413

[58] Field of Search ..... 175/391, 413, 175/421, 327, 335, 384; 299/79.1, 110, 106

[56] References Cited

U.S. PATENT DOCUMENTS

| | | | |
|---|---|---|---|
| 1,873,814 | 8/1932 | Brewster . | |
| 1,923,488 | 8/1933 | Howard et al. | 175/426 |
| 1,949,591 | 3/1934 | Vaughn | 175/327 |
| 2,074,951 | 3/1937 | Zublin | 175/397 |
| 2,182,035 | 12/1939 | Purnell . | |
| 2,568,573 | 9/1951 | Walker . | |
| 3,519,309 | 7/1970 | Engle et al. . | |
| 3,720,273 | 3/1973 | McKenry et al. | 175/335 |
| 3,821,993 | 7/1974 | Kniff et al. | 175/292 |
| 4,485,655 | 12/1984 | Ewing . | |
| 4,813,501 | 3/1989 | Mills et al. . | |
| 5,103,922 | 4/1992 | Jones | 175/429 |
| 5,238,075 | 8/1993 | Keith et al. . | |
| 5,366,031 | 11/1994 | Rickards . | |
| 5,417,292 | 5/1995 | Polakoff | 175/335 |
| 5,427,191 | 6/1995 | Richards . | |
| 5,497,843 | 3/1996 | Burns et al. | 175/403 |
| 5,687,807 | 11/1997 | Woods et al. | 175/393 |

FOREIGN PATENT DOCUMENTS

| | | |
|---|---|---|
| 2407746 | 9/1974 | Germany . |
| 512263 | 6/1976 | U.S.S.R. . |
| 1581837 | 7/1990 | U.S.S.R. . |
| 1819970 | 6/1993 | U.S.S.R. . |

*Primary Examiner*—Hoang C. Dang
*Attorney, Agent, or Firm*—Richard C. Litman

[57] ABSTRACT

A rotary mining bit is particularly suitable for use in the drilling of blasting holes in the mining industry, but may also be used for drilling wells and the like in both soft materials and hard, rocky materials. The bit comprises a central hollow body with a plurality of wings extending outwardly therefrom, with each wing having a leading edge with a plurality of cutting tooth sockets disposed therealong and each of the sockets having a cutting tooth affixed therein. The outermost cutting teeth on each wing describe a gauge row diameter, which defines the diameter of a hole formed using the present bit. The outermost cutting teeth are each angled outwardly, away from the axis of the bit and lateral edge of the wing. An inner or apex row of teeth describes a smaller cutting circle diameter, with intermediate teeth on each row preferably being irregularly spaced between the outermost and innermost teeth on each respective wing, so each intermediate tooth describes a different diameter circle from the others. The back of each cutting tooth is accessible through the open back of its respective socket, allowing the teeth to be driven out for replacement as required without need for special tools or fittings. The large central passage through the body of the bit allows air and/or liquid coolant and/or lubricant to pass through the body essentially unimpeded, and to resist clogging or plugging due to debris in the hole during drilling operations.

20 Claims, 7 Drawing Sheets

MINING BIT

BACKGROUND OF THE INVENTION

1. Field of the Invention

The present invention relates generally to equipment used in the mining industry, and more specifically to a drill bit used in the drilling of holes in material for the insertion of explosive charges therein. The bit includes a plurality of wings extending forwardly from the drill stem attachment pin, with each of the wings including a plurality of hardened teeth projecting forwardly therefrom. The teeth are disposed in sockets along the leading edges of the wings, from which they may be driven and replaced if broken. The teeth are arranged with certain specific outwardly and forwardly projecting angles and spacing therebetween, for optimum efficiency. The bit is also well adapted for the drilling of wells and other boring in the earth, and works well when drilling rock and other hard materials, as well as softer materials.

2. Description of the Prior Art

Relatively large rotary drills are commonly used in the mining industry for the drilling of holes in ore beds and strata, into which explosive charges are placed to break up the ore for transport from the mine. Various types of drill bits have been developed in the past, including drag bits, claw bits, conical bits, etc., in attempts to provide greater longevity and efficiency.

Another problem which occurs frequently in such drilling operations, is that of encountering clay, mud, or other soft and viscous material. Practically all drills include a hollow stem portion and one or more passages through the bit, providing for the delivery of air and/or liquid to the working face of the hole to cool the bit and flush debris from the hole, about the periphery of the bit and drill stem. However, the relatively small passages provided in most drill bits tend to clog with mud and debris, thus limiting the advance speed of the drill.

Most such drill bits use steel conical cutting elements or teeth with extremely hard tungsten carbide tips secured into sockets in the forward or working ends of the cutters. Most drill bits provide for the replacement of the cutters or teeth, as they are obviously prone to wear and damage. It is important that these teeth be securely held within the drill bit, and thus most such bits require specialized tools for the extraction and insertion of the cutting teeth, which process requires some additional time.

Accordingly, a need arises for a mining bit which overcomes the various problems discussed above. The bit is configured with a plurality of radially disposed "wings" extending from a conical center body, with each wing having a plurality of cutting tooth pockets along the leading edge thereof. The pockets, and thus the cutting teeth, have different spacing along each wing so that the central teeth along each wing are cutting along different paths for greater efficiency. The relatively large number of cutting teeth also increase the longevity of the bit, requiring fewer replacements.

The relatively large passage between the wings and into the hollow conical body of the bit allows a greater flow of air and/or liquid coolant and/or lubricant therethrough, thus allowing more rapid advance of the drill bit with less clogging. Also, the cutting teeth of the present bit are easily removed and replaced without need for special tools, as the backs of the cutter sockets are exposed so the cutting elements may be driven out readily and replaced with a hammer and punch. A discussion of the prior art of which the present inventor is aware, and the differences between the known prior art and the present invention, is provided below.

U.S. Pat. No. 1,873,814 issued on Aug. 23, 1932 to Harry C. Brewster describes a Coupling For Drill Bits serving to prevent inadvertent uncoupling of the bit from the end of the drill stem or steel. The bit disclosed is a "fishtail" or drag bit having a plurality of reamer type blades, and bears no relationship to the winged claw bit of the present invention.

U.S. Pat. No. 2,182,035 issued on Dec. 5, 1939 to Guy Purnell describes a Detachable Blade Core Bit, generally comprising a drag bit along the lines of the Brewster bit discussed immediately above. Purnell rivets his blades to the head of the bit to provide for their removal, thus requiring special tools for the removal of old rivets and installation of new rivets when replacing the blades. In any event, such a drag or reamer bit configuration is unrelated to the winged claw bit of the present invention.

U.S. Pat. No. 2,568,573 issued on Sep. 18, 1951 to Elzo G. Walker describes a Well Drill Bit of the drag or reamer bit type, wherein the bit includes an inner and an outer cutting member on each of the three elements. The inner and outer members are each differently spaced and arrayed on each element, so the paths taken by the respective inner elements and outer elements are not duplicated. While the present invention may include a non-symmetrical array of cutting teeth or elements, the present bit has a winged claw configuration rather than a drag or reamer configuration, as well as numerous other distinctions over Walker.

U.S. Pat. No. 3,519,309 issued on Jul. 7, 1970 to Edgar W. Engle et al. describes a Rotary Cone Bit Retained By Captive Keeper Ring. The bit disclosed is essentially what is described as a cutter or tooth in the present disclosure. Engle does not disclose an entire rotary drilling bit in his patent, whereas the present disclosure is directed to such a rotary drilling bit having a plurality of cutting teeth thereon in a specific array, with means for securing the teeth to the bit and other advantageous features also being disclosed.

U.S. Pat. No. 4,485,655 issued on Dec. 4, 1984 to Peter D. Ewing describes a Tool Holder And Mining Tool Bit And Method For Making Same. The mining tool bit disclosed is again essentially a cutter or tooth as described in the present disclosure. Ewing does not disclose an entire rotary drill bit, as defined in the present disclosure. Moreover, the Ewing cutter tooth requires a special holder retaining fitting, unlike the bit of the present invention.

U.S. Pat. No. 4,813,501 issued on Mar. 21, 1989 to Charles D. Mills et al. describes a Rotary Mining Bit having a plurality of cutting elements disposed therearound; this type of bit is known generally as a "claw" bit. An outer or gauge row includes three cutting elements disposed in a circle about the axis of the bit, while the inner elements may be angled so their tips are disposed at different radial distances from the axis. No additional elements are disclosed, as the center of the bit includes a large, solid pilot cutter, unlike the present bit. The present bit is constructed of three or more wings or plates, with each including a plurality of cutters disposed along the leading edge thereof. The absence of a solid pilot cutter in the center of the present bit enables air and/or liquid coolant and/or lubricant to flow downwardly through the center of the body of the bit in an essentially unrestricted path to cool and lubricate the cutting teeth, as well as flushing debris from the working face of the hole to flow about the outer circumference due to the outward spacing of the gauge row of cutters. The fluid ports of the Mills et al. bit are limited, due to their offset disposition in the body and smaller diameters necessary to provide for the central pilot cutter. Also, due to the large triangular body of the Mills et al. bit, at least some of the rearward ends of the cutting elements are most difficult to access, to drive from their respective holders. Extraction of a broken element would be most difficult with the Mills et al. bit, whereas cutting elements of the present bit are easily driven out from behind.

U.S. Pat. No. 5,238,075 issued on Aug. 24, 1993 to Carl W. Keith et al. describes a Drill Bit With Improved Cutter Sizing Pattern. The bit comprises a series of wings or blades, with each blade having a plurality of different diameters of cutting elements installed thereon. The arrangement on each wing is different, so that the cutting paths of each of the elements overlaps. This assures that portions of each element remain sharp, rather than simultaneously becoming dulled with use. While this may be a desirable goal, the arrangement teaches away from the present invention, where it is desired for at least the intermediate cutting element positions on each wing to be clear of those respective elements on other wings. Moreover, Keith et al. are silent regarding the specific installation or replacement of cutting elements. The several offset passages through the bit to the hollow drill stem are each relatively small, thus limiting the air or liquid flow therethrough and possibly leading to clogging or jamming of the bit if the coolant and lubricant passages become blocked by clay and/or other debris from the working face of the hole. Also, the wings of the Keith et al. bit are twisted relative to the rotational axis of the bit, thus complicating manufacture, while the present bit wings are flat, planar plates parallel to the rotational axis of the bit. The three different cutting element sizes used in the Keith et al. bit further complicate manufacture and increase expense. The present bit uses only a single size of easily replaceable cutting element, thus making field replacement considerably easier, simpler, and more economical.

U.S. Pat. No. 5,366,031 issued on Nov. 22, 1994 to Brian Rickards describes an Auger Head Assembly And Method Of Drilling Hard Earth Formations. Rickards discloses asymmetrically positioned intermediate cutting elements on opposite sides of a pilot head, which asymmetric cutting element disposition is also a feature of the present invention. However, Rickards incorporates this feature on an auger, rather than on a drill bit which is removably attachable to a drill stem. The auger has only a single spiraling flight or pitch about its solid central shaft, providing for the attachment of only one of the cutting element assemblies to the leading edge thereof; the opposite assembly requires an additional attachment point. The present wing bit is capable of taking considerably more working force, in that the wings are each parallel to the rotational axis of the bit, rather than being twisted in a spiral. Also, the solid shaft of the Rickards auger does not provide any means of delivering coolant or lubricant air or liquid to the working face of the hole, as provided by the present mining bit.

U.S. Pat. No. 5,427,191 issued on Jun. 27, 1995 to Brian Rickards describes an Auger Head Assembly And Method Of Drilling Hard Earth Formations. (This patent is a continuation in part of the '031 patent discussed immediately above.) The disclosed device is extremely closely related to that of the '031 patent discussed above, and the same points raised in the discussion of the '031 patent also apply here.

German Patent Publication No. 2,407,746 published on Sep. 19, 1974 illustrates a cutting tooth and holder construction for an excavating tool. The configuration is closely related to various other cutting tools and holders or sockets discussed further above and disclosed in various of the patents discussed above. Various configurations of cutting teeth arrays with drill bits are disclosed, but none provide easy access to the back of the cutting teeth in order for a worn or damaged cutting tooth to be driven from the back of its socket, as provided by the present invention.

Soviet Patent Publication No. 512,263 published on Jun. 22, 1976 illustrates a rotary cutter for cutting tunnel bores, having remotely changeable cutters for different conditions. Different cutting elements are disposed on opposite sides of radial arms extending from a central shaft. Turning a bevel gear within the shaft rotates the arms to place different cutting elements at the front of the device, depending upon the material being cut (rock, softer soil, etc.). It appears that the cutting elements on each arm are not radially symmetrical with one another, which feature is also provided by the present invention. However, the disclosure fails to provide for any central passage for the delivery of air or liquid to the hole, nor means for quickly and easily changing individual cutting elements, as provided by the present invention.

Soviet Patent Publication No. 1,581,837 published on Jul. 30, 1990 illustrates a rotary percussive drill bit having a particular cutting element configuration. No wings, central passage, or ease of replacement of the cutting elements is disclosed.

Finally, Soviet Patent Publication No. 1,189,970 published on Jun. 7, 1993 illustrates a reamer having circumferential cutting elements projecting therefrom. The reamer includes a hollow central shaft, but no cutting elements are disposed at the head of the shaft. The device is strictly a reamer, and cannot be used to form or deepen a hole. No means of easily replacing the cutting elements is disclosed, as they are threaded and soldered within their respective sleeves.

None of the above inventions and patents, taken either singly or in combination, is seen to describe the instant invention as claimed.

SUMMARY OF THE INVENTION

Accordingly, it is a principal object of the invention to provide an improved rotary mining bit which is particularly adapted for the drilling of blast holes in the mining industry, but which may also be useful for the drilling of holes in the earth for wells and the like.

It is another object of the invention to provide an improved mining bit which is adapted for the drilling of soft deposits but which is also well adapted for use in drilling harder rocky minerals and the like.

It is a further object of the invention to provide an improved mining bit comprising a hollow central body having a plurality of wings extending therefrom, with each of the wings having a leading edge with a plurality of cutting teeth extending therefrom.

An additional object of the invention is to provide an improved mining bit which cutting teeth are each immovably affixed within a socket, with each tooth having an accessible back enabling the tooth to be driven from the socket as required.

Another object of the invention is to provide an improved mining bit which teeth form an outermost circumferential gauge row about the peripheries of the wings, an innermost row adjacent the inner edges of the wings, and at least one central tooth on each wing between the outer and inner teeth, with the central tooth being variably spaced from the outer and inner teeth on each wing.

Still another object of the invention is to provide an improved mining bit which outermost cutting teeth are disposed at an outwardly extending angle from the leading edge of the wings, to describe a maximum diameter for the bit and a drill hole diameter for a hole drilled by the bit.

Yet another object of the invention is to provide an improved mining bit which hollow central body includes a single large axial passage therethrough, providing for the essentially unrestricted flow of air and/or liquid therethrough for cooling and/or lubrication, and substantially reducing clogging of the drill bit.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a rotary mining bit, which may be used for the drilling of blast holes in mineral deposits for the placement of explosives therein. The bit is particularly well adapted for use in relatively soft formations, but has also been found to work well in harder mineral deposits as well. While the present bit is particularly adapted for the drilling of blast holes in the mining industry, it will be seen that it is also adaptable for the drilling of holes for gas, oil, and water wells, as well as for the drilling of other holes for various other purposes.

Figure 1:
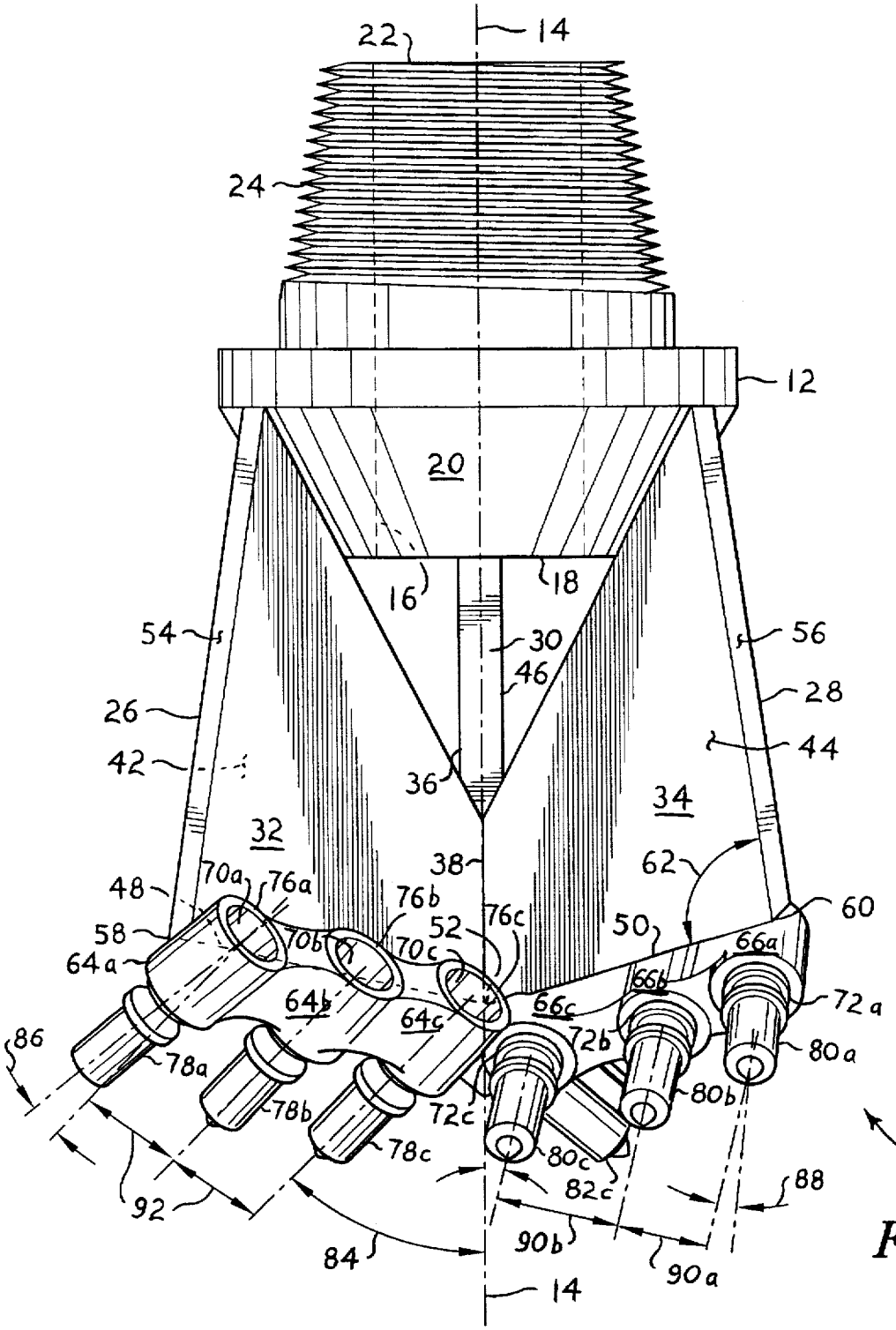
FIG. 1 is a side elevation view of a three winged mining bit of the present invention, showing its features.
Figure 2:
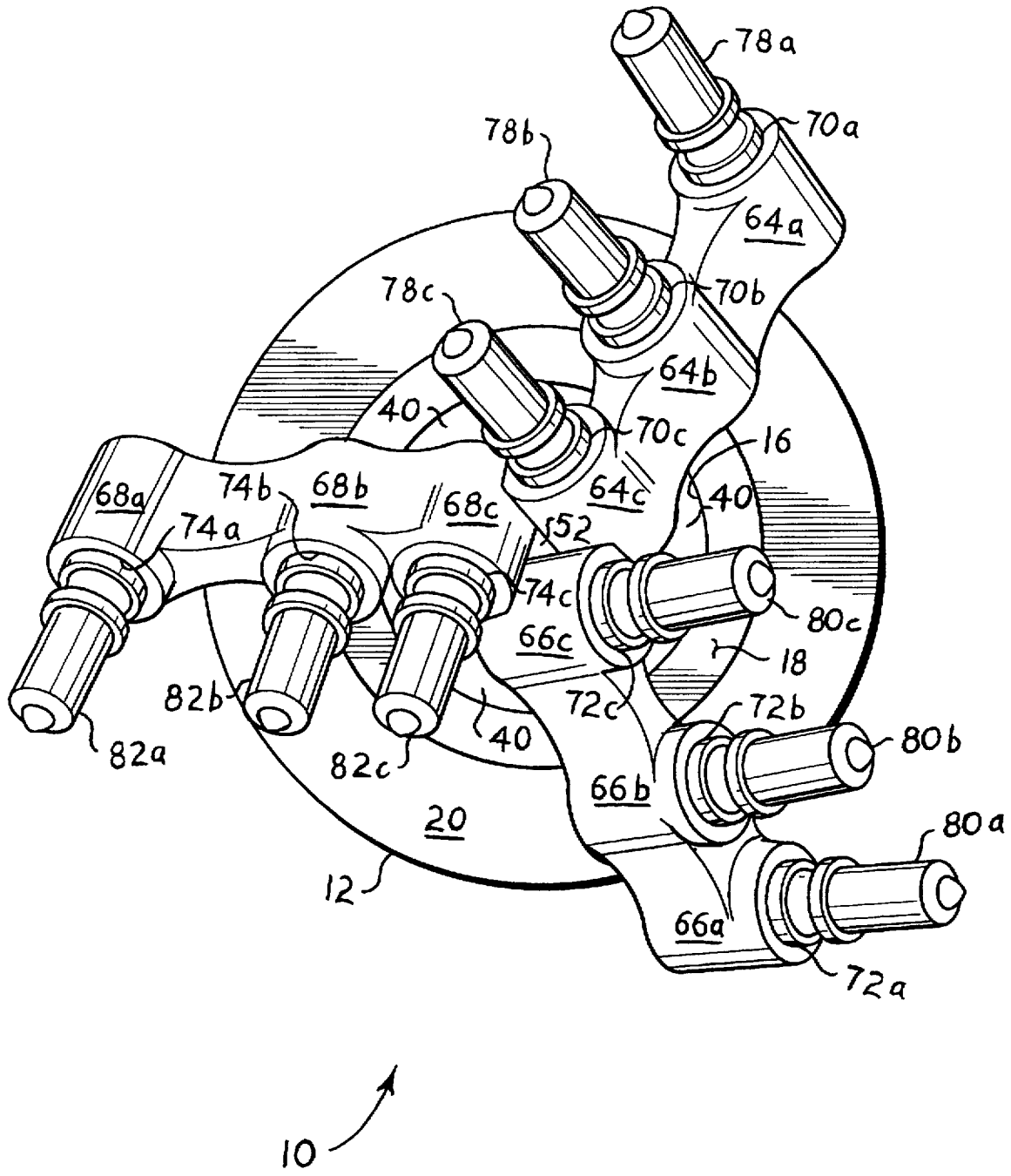
FIG. 2 is a working end plan view of the three winged bit of FIG. 1, showing further features and details of its configuration.

FIGS. 1 and 2 respectively disclose a side elevation view and a forward or working end view of a first embodiment of the present mining drill bit, designated with the reference numeral 10. The mining bit 10 includes a hollow central body 12 with a central axis 14, with the body 12 having a single large diameter passage 16 running therethrough and coaxial with the body 12 and axis 14. The forward or working end 18 of the body 12 is formed in a truncated conical shape 20, with the opposite rearward or attachment end 22 being adapted for the attachment of the bit 10 to a cooperating or mating drill stem or the like, e. g., by means of mating tapered threads 24. The central body 12 has a plurality of flat, planar wings (e.g., three wings 26, 28, and 30, in the case of the bit 10 of FIG. 1) extending radially outwardly from the central body 12 and preferably evenly spaced therearound, with each of the wings 26 through 30 being coplanar with the axis 14 of the central body 12.

Each of the wings 26 through 30 has a forward portion, respectively 32, 34, and 36, which extends forwardly past the forward or working end 18 of the central body 12. These wing forward portions 32/34/36 each extend inwardly to the central axis 14 of the bit 10, where they are joined to one another (welded, etc.) to form a wing juncture 38 which is coaxial with the central axis 14 of the bit 10.

The present mining bit 10 may be provided in various different diameters, depending primarily upon the diameter of the circle described by the outermost dimension of the wings 26/28/30, as well as the diameter of the body 12. Drill bit diameters ranging from approximately four inches up to or beyond twelve inches may be formed using the present drill bit construction. However, in consideration of the extreme resistance in drilling dense minerals and the like, the wings 26/28/30 are preferably relatively thick, having a thickness on the order of one inch or thereabouts. (Smaller diameter drill bits may have wings of a lesser thickness, if desired.) Notwithstanding the relatively great thickness of the wings 26/28/30, it will be seen that a drill bit 10 constructed in accordance with the present disclosure will nevertheless have a relatively narrow mass where the wings 26/28/30 are joined at their common wing juncture 38, at least in comparison to the diameter of the central passage 16 through the central body 12. Thus, coolant and/or lubricant flow is essentially unimpeded as it flows through the central passage 16 and along the central passage extension channels 40 (better shown in FIG. 2) defined by each wing juncture.

The above described extension channels 40 are each in alignment with the central passage 16, to provide the least impedance to air and/or liquid flow, to flush debris from the hole as the material is broken up at the working face of the hole being drilled by the present bit 10. This enables the present bit 10 to clear debris from a hole being drilled, much more efficiently than drill bits of the prior art, as will be shown further below in a detailed discussion of the advantages of the present drill bit construction over the prior art. Preferably, the central passage 16 has a diameter at least one third that of the maximum diameter of the central body 12, in order to provide a relatively large passageway for debris. As an example, the present inventor has constructed a model of the invention wherein the central body portion 12 is machined from eight inch round stock having a two and three quarter inch diameter passage therethrough, resulting in a passage having a diameter slightly greater than thirty four percent that of the body 12. However, other passage-to-body diameter ratios may be used as desired.

Each of the wings 26/28/30 will also be seen to have a forward or working face, respectively 42/44/46, which is defined as the face of the wing 26/28/30 which is facing in the direction of rotation of the bit 10. Each wing 26/28/30 also has a leading edge, e. g., leading edges 48 and 50 as shown in FIG. 1; the third wing leading edge is concealed in the drawing figures, but will be understood to be essentially identical to those described for the first and second wings 26 and 28.

Each wing leading edge, e. g., edges 48 and 50, are tapered outwardly and rearwardly, preferably on the order of fifteen to twenty degrees as measured from a flat working surface normal to central axis 14. This taper extends from the bit apex 52, defined as the point at which all three wing leading edges join at the forwardmost point of the wing juncture 38. Greater or lesser taper angles may be used as desired. Each of the wings 26/28/30 also has an outer lateral edge, e.g., lateral edges 54 and 56 of the first two wings 26 and 28 as shown in FIG. 1, with the concealed lateral edge of the third wing 30 being essentially identical to the first two lateral edges 54 and 56. The intersection of the lateral edge and leading edge of each wing defines a gauge point, e. g., the first wing leading edge 48 and lateral edge 54 define a first wing gauge point 58, with the second wing leading edge 50 and lateral edge 56 defining a second wing gauge point 60.

The lateral edge of each of the wings is also tapered inwardly and rearwardly toward the central axis 14 from the respective gauge point of each of the wings, to provide greater diametric clearance about the body portion 12 of the mining bit 10. Preferably, the taper is substantially the same as the leading edge taper, i. e., some fifteen to twenty degrees inward and rearward; other lateral edge taper angles may be used as desired. Equal leading edge and lateral edge tapers provide an included angle of ninety degrees between the leading edge and lateral edge of each wing, as shown by the angle 62 about the gauge point 60 of the second wing 28. (The angle 62 appears greater due to foreshortening in the drawing.)

Each of the wing leading edges includes a plurality of spaced apart cutting tooth sockets affixed therealong, with all of the sockets along each leading edge of each wing being shown in the working end view of FIG. 2. These sockets are designated respectively as sockets 64*a*, 64*b*, and 64*c* along the leading edge 48 of the first wing 26, sockets 66*a*, 66*b*, and 66*c* along the leading edge 50 of the second wing 28, and sockets 68*a*, 68*b*, and 68*c* along the leading edge of the third wing 30, with sockets a, b, and c of each wing 26/28/30 being placed from the respective gauge point of each wing, inwardly toward the bit apex 52. Each of these sockets is solidly affixed to the leading edge of its respective wing, by building up additional metal around each socket by welding, or by using other suitable technique.

Each socket has a coaxial cutting tooth passage, designated as 70*a*, 70*b*, and 70*c* for the first wing sockets 64*a*, 64*b*, and 64*c*, second wing socket passages 72*a*, 72*b*, and 72*c* for the sockets 66*a*, 66*b*, and 66*c*, and third wing socket passages 74*a*, 74*b*, and 74*c* for third wing sockets 68*a*, 68*b*, and 68*c*. These passages each extend completely through their respective sockets and through the rear face of each of the sockets, as shown by the socket rear faces 76*a*, 76*b*, and 76*c* of the first wing sockets 64*a*, 64*b*, and 64*c* shown in FIG. 1. It will be seen in FIG. 1 that each of these socket rear faces, e. g., 76*a*, 76*b*, and 76*c*, and their respective socket passages 70*a*, 70*b*, and 70*c* are easily accessible, and are not blocked or covered by other drill bit structure, due to the angle at which they are affixed to their respective wings.

These socket passages are each adapted to secure a hardened cutting tooth tightly and coaxially therein, by means of providing each socket passage with an interference fit with a cutting tooth driven therein. These cutting teeth are designated as teeth 78*a*, 78*b*, and 78*c* for the first wing sockets 64*a*, 64*b*, and 64*c*; teeth 80*a*, 80*b*, and 80*c*, for the second wing sockets 66*a*, 66*b*, and 66*c*; and teeth 82*a*, 82*b*, and 82*c* for the third wing sockets 68*a*, 68*b*, and 68*c*. The open rear face of each of the sockets, providing access to their respective socket passages, allows a broken or worn cutting tooth to be driven out of its respective socket passage using a hammer and drift, without need of specialized tools to remove specialized retainers, threaded fittings, solder, etc.

The cutting tooth sockets and cutting teeth are not aligned with their axes parallel to the planes of their respective wings, but rather are angled forwardly and downwardly about fifty to fifty five degrees relative to the respective forward faces of their wings. In other words, each of the cutting tooth sockets and cutting teeth therein is inclined forwardly from the plane of the front face of its respective wing, preferably between fifty and fifty five degrees. Another way of stating this is that each socket and its associated cutting tooth is angled downwardly preferably between thirty five and forty degrees from a plane extending from the leading edge of its respective blade, and normal to the front face thereof. This angular displacement is indicated by the angle 84 in FIG. 1. (This angle appears less than the actual angle, due to foreshortening in the drawing.)

While the inner tooth sockets and cutting teeth are preferably disposed in a plane parallel to the lateral edges of their respective wings, the outermost or gauge point teeth 78*a*, 80*a*, and 82*a* are angled outwardly from their respective wing lateral edges 54/56/58, preferably at an angle of some fifteen degrees therefrom, as shown by the angles 86 and 88 in FIG. 1. (As in other angles shown in FIG. 1, it will be seen that the first and second wings 26 and 28 are foreshortened due to their 120 degree included angle therebetween, and thus the angles shown are also foreshortened.) Thus, with the wing lateral edges having angles of some fifteen degrees relative to the central axis 14, as described further above, and the gauge point sockets and teeth having further outward angles of some fifteen degrees relative to their respective wing lateral edges, it will be seen that the outermost or gauge point cutting teeth 78*a*, 80*a*, and 82*a* are each angled outwardly from the central axis on the order of thirty degrees, thus defining the diameter or gauge of a hole being drilled using the present bit 10.

It will be noted that several of the cutting tooth sockets and their respective teeth are also spaced at various distances from one another. While each of the gauge point row cutting teeth 78*a*, 80*a*, and 82*a* are spaced at the same distance from the axis 14 to describe a uniform diameter hole, and the innermost cutting teeth 78*c*, 80*c*, and 82*c* are also equally spaced from the axis 14, the intermediate sockets 64*b*, 66*b*, and 68*b* and their respective teeth 78*b*, 80*b*, and 82*b* may be variably spaced from the central axis 14 and from the innermost and outermost sockets and respective teeth.

As an example of the above irregular spacing, it will be noted that the intermediate cutting tooth 80*b* of the second wing 28 is positioned a shorter distance 90*a* from the outermost tooth 80*a* of that row, and a longer distance 90*b* from the innermost tooth 80*c*. Conversely, the intermediate cutting tooth 82*b* will be seen to be closer to the innermost tooth 82*c* than to the outermost gauge row tooth 82*a*, in FIG. 2. The first wing intermediate tooth 78*b* may be positioned equidistantly between the outermost and innermost teeth 78*a* and 78*c*, as indicated by the equal distance arrows 92. The variable spacing of the intermediate teeth 78*b*, 80*b*, and 82*b* from the central axis 14, results in each of these intermediate teeth cutting a slightly different radial path than the other intermediate teeth for greater efficiency, rather than following in the track or path of the immediately preceding intermediate tooth.

The above described bit 10 includes three wings, each having three cutting tooth sockets and cutting teeth extending therefrom. However, it will be seen that the present invention may be extended to bits having a different (preferably greater) number of blades, and a different (preferably greater) number of cutting tooth sockets and cutting teeth along the leading edge of each of the blades.

Figure 3:
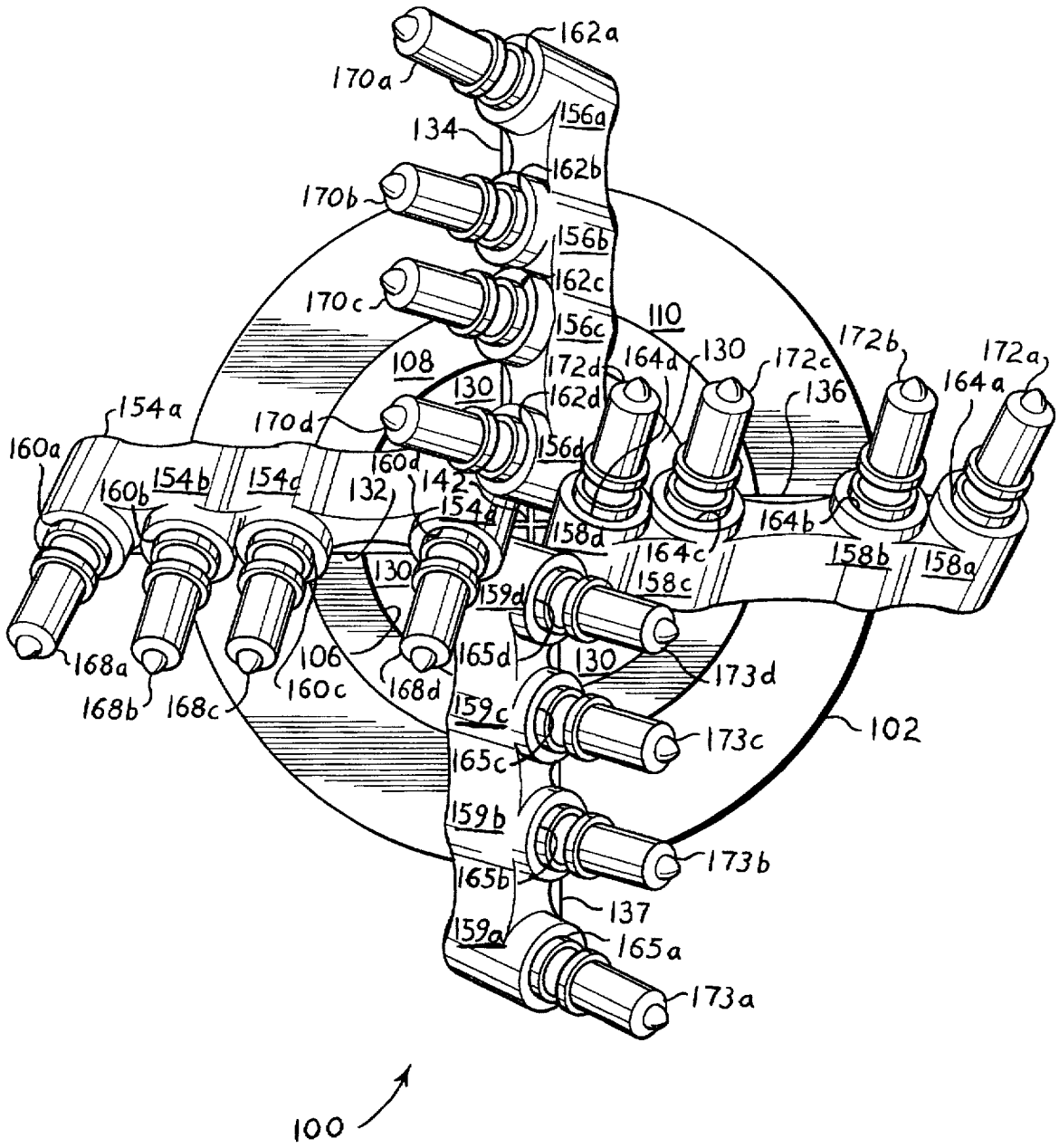
FIG. 3 is a working end plan view of an alternative embodiment bit having four wings and four cutting teeth per wing, showing various features and details thereof.
Figure 4:
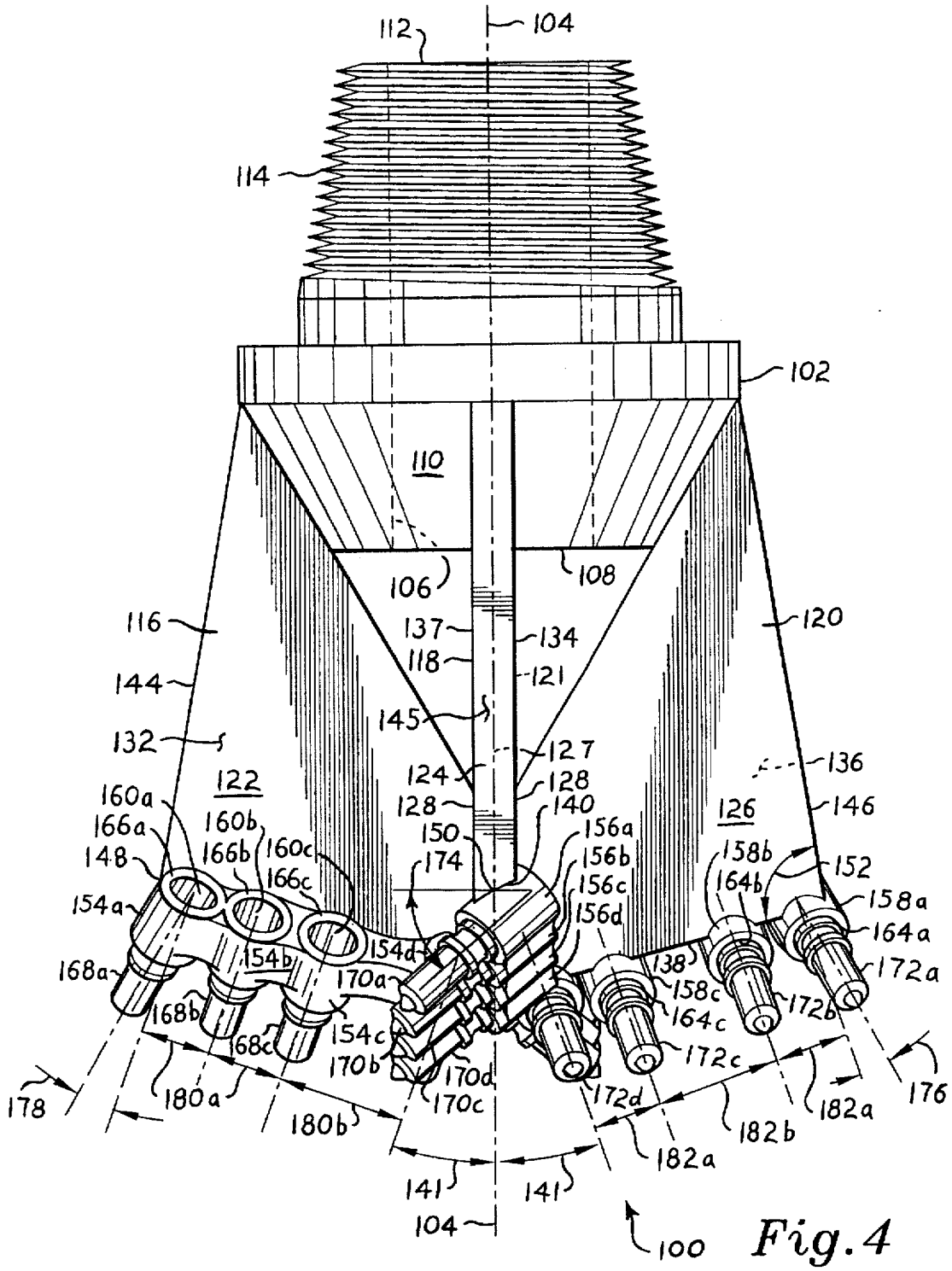
FIG. 4 is a side elevation view of the four winged bit of FIG. 3, showing the angle of attack of the cutting teeth relative to the plane of the wing, as well as further details.

FIGS. 3 and 4 provide an example of such a variation, where a mining bit 100 is provided with four wings and with each of the wings including four cutting tooth sockets and cutting teeth therealong. In other respects, it will be seen that the mining bit 100 of FIGS. 3 and 4 is generally similar to the mining bit 10 of FIGS. 1 and 2.

The mining bit 100 includes a hollow central body 102 with a central axis 104, with the body 102 having a single large diameter passage 106 running therethrough and coaxial with the body 102 and axis 104. The forward or working end 108 of the body 102 is formed in a truncated conical shape 110, with the opposite rearward or attachment end 112 being adapted for the attachment of the bit 100 to a cooperating or mating drill stem or the like, e. g., by means of mating tapered threads 114. The central body 102 has a plurality of flat, planar wings (e.g., first through fourth wings 116, 118, 120, and 121, with the fourth wing 121 being concealed behind the edge-on view of the second wing 118, in the case of the bit 100 of FIGS. 3 and 4) extending radially outwardly from the central body 102 and preferably evenly spaced therearound, with each of the wings being coplanar with the axis 104 of the central body 102.

Each of the wings 116 through 121 has a forward portion, respectively 122, 124, 126, and 127, which extends forwardly past the forward or working end 108 of the central body 102. These wing forward portions 122/124/126/127 each extend inwardly to the central axis 104 of the bit 100, where they are joined to one another (welded, etc.) to form a wing juncture 128 which is coaxial with the central axis 104 of the bit 100. Thus, the basic configuration of the four wing bit 100 of FIGS. 3 and 4 is similar to that of the three wing bit 10 of FIGS. 1 and 2. It will be seen that a greater or fewer number of wings may be used, as desired.

As in the case of the bit 10 of FIGS. 1 and 2, the mining bit 100 of FIGS. 3 and 4 may be provided in various different diameters, depending primarily upon the diameter of the circle described by the outermost dimension of the wings 116/118/120/121, as well as the diameter of the central body 12. Preferably, the wings 116/118/120/121 are formed of relatively thick material, for good strength and durability, as in the three winged mining bit 10 of FIGS. 1 and 2. Even so, such a drill bit 100 will have a relatively narrow mass where the four wings 116/118/120/121 are joined at their common wing juncture 128, at least in comparison to the diameter of the central passage 106 through the central body 102. Thus, coolant and/or lubricant flow is essentially unimpeded as it flows through the central passage 106 and along the central passage extension channels 130 defined by each wing juncture 128.

As in the case of the mining bit 10 of FIGS. 1 and 2, the above described extension channels 130 are each in alignment with the central passage 106, to provide the least impedance to air and/or liquid flow through the bit 100 to flush debris from the hole being drilled by the bit 100. This enables the bit 100 to clear debris from a hole being drilled, much more efficiently than drill bits of the prior art, as will be shown further below in a detailed discussion of the advantages of the present drill bit construction over the prior art. As in the bit 10 of FIGS. 1 and 2, the central passage 106 preferably has a diameter at least one third that of the maximum diameter of the central body 102, in order to provide a relatively large passageway for air and liquid.

Each of the wings 116/118/120/121 also has a forward or working face, respectively 132/134/136/137, which is defined as the face of the wing 116/118/120/121 which is facing in the direction of rotation of the bit 100. Each wing 116/118/120/121 also has a leading edge, e.g., leading edges 138 and 140 as shown in FIG. 4; the third and fourth wing leading edges are concealed in FIGS. 3 and 4, but will be understood to be essentially identical to those described for the first and second wings 116 and 118.

Each wing leading edge, e. g., edges 138 and 140, are tapered outwardly and rearwardly, preferably on the order of fifteen to twenty degrees as in the case of the bit 10 of FIGS. 1 and 2. This leading edge taper angle 141 is indicated as the angle between the central axis 104 and a line normal to the leading edges of the first and third wings 116 and 120 in FIG. 4. This taper extends from the bit apex 142, defined as the point at which all four wing leading edges join at the forwardmost point of the wing juncture 128. Greater or lesser taper angles may be used as desired. Each of the wings 116/118/120/121 also has an outer lateral edge, e. g., lateral edges 144, 145, and 146 of the first three wings 116, 118, and 120 as shown in FIG. 4, with the concealed lateral edge of the fourth wing 121 being essentially identical to the first three lateral edges 144, 145, and 146. The intersection of the lateral edge and leading edge of each wing defines a gauge point, e. g., the first wing leading edge 138 and lateral edge 144 define a first wing gauge point 148, with the second wing leading edge 140 and lateral edge 145 defining a second wing gauge point 150.

As in the three winged bit 10 of FIGS. 1 and 2, the lateral edge of each of the wings of the four wing bit 100 of FIGS. 3 and 4 is also tapered inwardly and rearwardly toward the central axis 104 from the respective gauge point of each of the wings, to provide greater diametric clearance about the body portion 102 of the mining bit 100. Preferably, the taper is substantially the same as the leading edge taper, i. e., some fifteen to twenty degrees inward and rearward; other lateral edge taper angles may be used as desired. Equal leading edge and lateral edge tapers provide an included angle of ninety degrees between the leading edge and lateral edge of each wing, as shown by the angle 152 about the gauge point 148 of the first wing 116.

Each of the wing leading edges of the four winged bit 100 includes a plurality of spaced apart cutting tooth sockets affixed therealong, with all of the sockets along each leading edge of each wing being shown in the working end view of FIG. 3. These sockets are designated respectively as sockets **154*a*, 154*b*, 154*c*, and 154*d* along the leading edge 138 of the first wing 116, sockets 156*a*, 156*b*, 156*c*, and 156*d* along the leading edge 140 of the second wing 118, sockets 158*a*, 158*b*, 158*c*, and 158*d* along the leading edge of the third wing 120, and sockets 159*a*, 159*b*, 159*c*, and 159*d* along the leading edge of the fourth wing 121, with sockets a, b, c, and d of each wing 116/118/120/121 being placed from the respective gauge point of each wing, inwardly toward the bit apex 142. Each of these sockets is solidly affixed to the leading edge of its respective wing, as described for the bit 10** of FIGS. 1 and 2.

As in the three winged bit 10 of FIGS. 1 and 2, each socket has a coaxial cutting tooth passage, designated as **160*a*, 160*b*, 160*c*, and 160*d* for the first wing sockets 154*a*, 154*b*, 154*c*, and 154*d*, second wing socket passages 162*a*, 162*b*, 162*c*, and 162*d* for the sockets 156*a*, 156*b*, 156*c*, and 156*d*, third wing socket passages 164*a*, 164*b*, 164*c*, and 164*d* for third wing sockets 158*a*, 158*b*, 158*c*, and 158*d*, and fourth wing socket passages 165*a*, 165*b*, 165*c*, and 165*d* for the fourth wing sockets 159*a*, 159*b*, 159*c*, and 159*d*. These passages each extend completely through their respective sockets and through the rear face of each of the sockets, as shown by the socket rear faces 166*a*, 166*b*, and 166*c* of the first wing sockets 154*a*, 154*b*, and 154*c* shown in FIG. 4. It will be seen in FIG. 4 that each of these socket rear faces, e. g., 166***a*, 166*b*, and 166*c*, and their respective socket passages 154*a*, 154*b*, and 154*c*, are easily accessible, and are not blocked or covered by other drill bit structure, due to the angle at which they are affixed to their respective wings.

As in the case of the three winged bit 10 of FIGS. 1 and 2, these socket passages are each adapted to secure a hardened cutting tooth tightly and coaxially therein, by means of providing each socket passage with an interference fit with a cutting tooth driven therein. These cutting teeth are designated as teeth 168*a*, 168*b*, 168*c*, and 168*d* for the first wing sockets 154*a*, 154*b*, 154*c*, and 154*d*; teeth 170*a*, 170*b*, 170*c*, and 170*d*, for the second wing sockets 156*a*, 156*b*, 156*c*, and 156*d*; teeth 172*a*, 172*b*, 172*c*, and 172*d* for the third wing sockets 158*a*, 158*b*, 158*c*, and 158*d*; and teeth 173*a*, 173*b*, 173*c*, and 173*d* for fourth wing sockets 159*a*, 159*b*, 159*c*, and 59*d*. The open and accessible rear face of each of the sockets provides the same advantages in the removal of broken or worn cutting teeth, as described above for the three winged mining bit 10 of FIGS. 1 and 2.

As in the case of the bit 10 of FIGS. 1 and 2, the cutting tooth sockets and cutting teeth of the four winged bit 100 are not aligned with their axes parallel to the planes of their respective wings, but rather are angled forwardly and downwardly about fifty to fifty five degrees relative to the respective forward faces of their wings. This angular displacement is indicated by the angle 174 in FIG. 4.

As in the three winged bit 10 of FIGS. 1 and 2, the outermost or gauge point teeth 168*a*, 170*a*, 172*a*, and 173*a* of the four winged bit 100 are angled outwardly from their respective wing lateral edges 144/146/148/149, preferably at an angle of some fifteen degrees therefrom, as shown by the angles 176 and 178 in FIG. 4. Thus, with the wing lateral edges having angles of some fifteen degrees relative to the central axis 104, as described further above, and the gauge point sockets and teeth having further outward angles of some fifteen degrees relative to their respective wing lateral edges, it will be seen that the four outermost or gauge point cutting teeth 168*a*, 170*a*, 172*a*, and 173*a* are each angled outwardly from the central axis 104 on the order of thirty degrees, thus defining the diameter or gauge of a hole being drilled using the four wing bit 100.

The four winged bit 100 of FIGS. 3 and 4 also has several of the cutting tooth sockets and their respective teeth spaced at various distances from one another. While each of the gauge point row cutting teeth 168*a*, 170*a*, 172*a*, and 173*a* are spaced at the same distance from the axis 104 to describe a uniform diameter hole, and the innermost cutting teeth 168*d*, 170*d*, 172*d*, and 173*d* may also be equally spaced from the axis 104, the intermediate socket pairs 154*b*/154*c*, 156*b*/156*c*, 158*b*/158*c*, and 159*b*/159*c* and their respective teeth 168*b*/168*c*, 170*b*/170*c*, 172*b*/172*c*, and 173*b*/173*c* may be variably spaced from the central axis 104 and from the innermost and outermost sockets and respective teeth.

As an example of the above irregular spacing, it will be noted that the second and third cutting teeth 168*b* and 168*c* of the first wing 116 are positioned a relatively shorter distance 180*a* from the outermost tooth 168*a* of that row, and a relatively longer distance 180*b* from the innermost tooth 168*d*. The opposite third wing 120 has its intermediate second and third teeth, respectively 172*b* and 172*c*, disposed so that each is a relatively closer distance 182*a* to the respective outer tooth 172*a* and innermost tooth 172*d*, while having a relatively larger distance 182*b* between the two intermediate cutting teeth 172*b*/172*c*. The second wing 118 may have its intermediate teeth arranged oppositely, with the two intermediate teeth 170*b*/170*c* positioned relatively close to one another, as shown in FIG. 3, with the fourth wing 121 having each of its cutting teeth 173*a*/173*b*/173*c*/173*d* evenly spaced from one another. Different spacing arrangements may be used as desired.

The above described differential spacing of at least the intermediate sockets 154*b*/154*c*, 156*b*/156*c*, 158*b*/158*c*, and 159*b*/159*c*, and their respective intermediate cutting teeth 168*b*/168*c*, 170*b*/170*c*, 172*b*/172*c*, and 173*b*/173*c* results in each of these intermediate teeth cutting a slightly different radial path than the other intermediate teeth for greater efficiency, rather than following in the track or path of the immediately preceding intermediate tooth. Again, it will be noted that different numbers of teeth may be provided for each of the wings, with different spacing or arrangement of cutting teeth along each of the wings.

Figure 5:
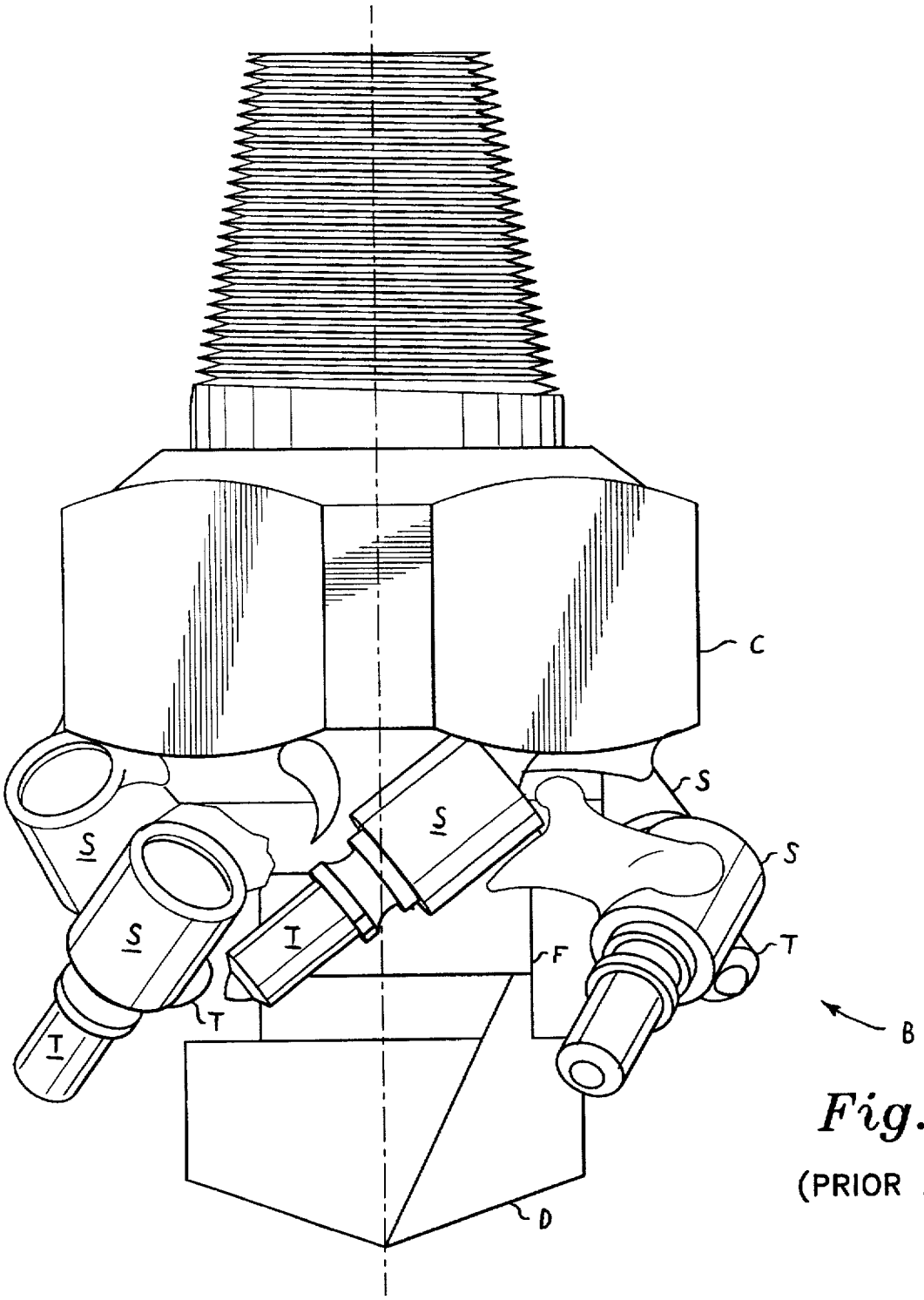
Fig.5 (PRIOR ART)
FIG. 5 is a side elevation view of a prior art claw bit, showing various features thereof.
Figure 6:
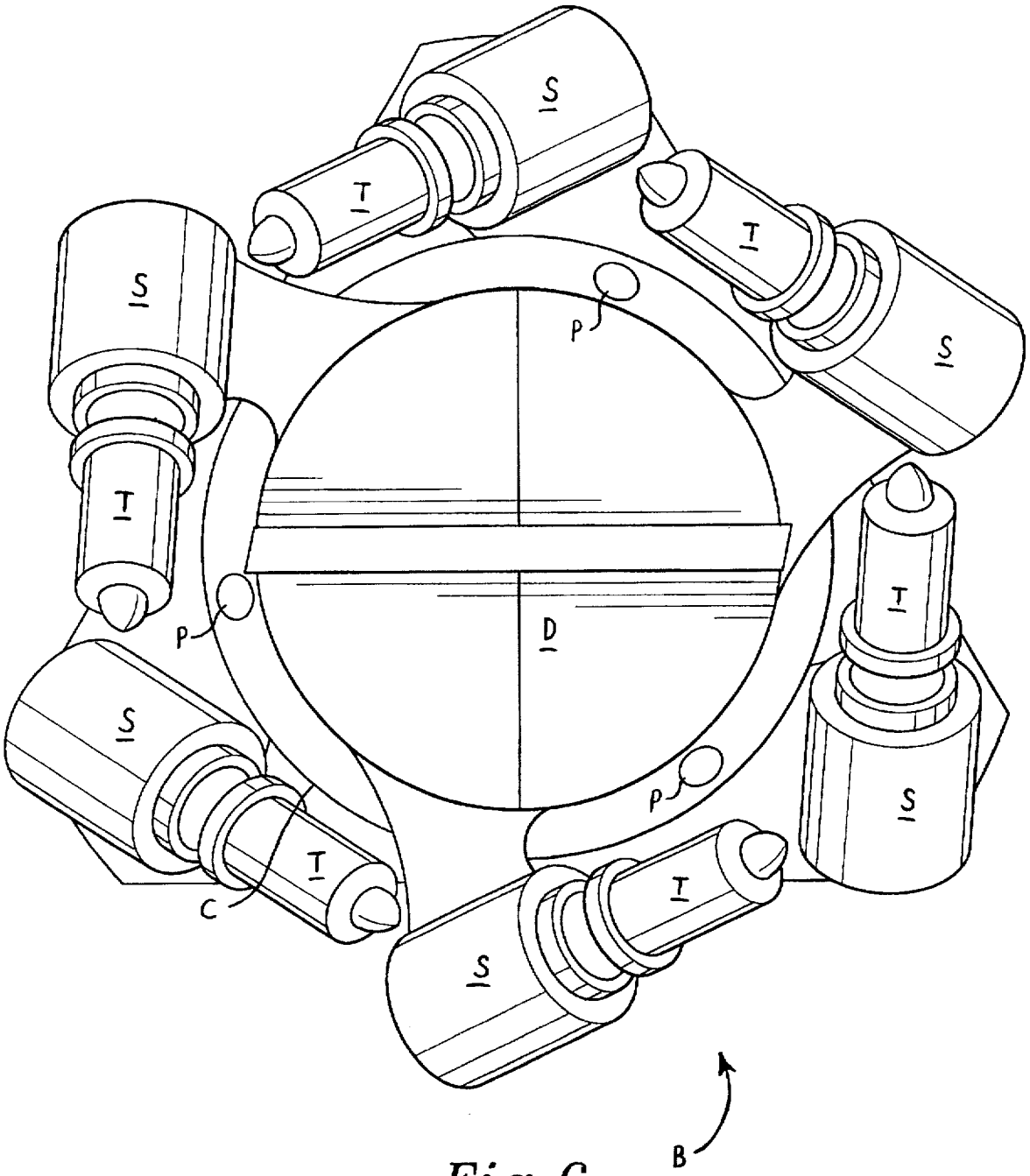
Fig. 6 (PRIOR ART)
FIG. 6 is a working end elevation view of the prior art claw bit of FIG. 5, showing further details.
Figure 7:
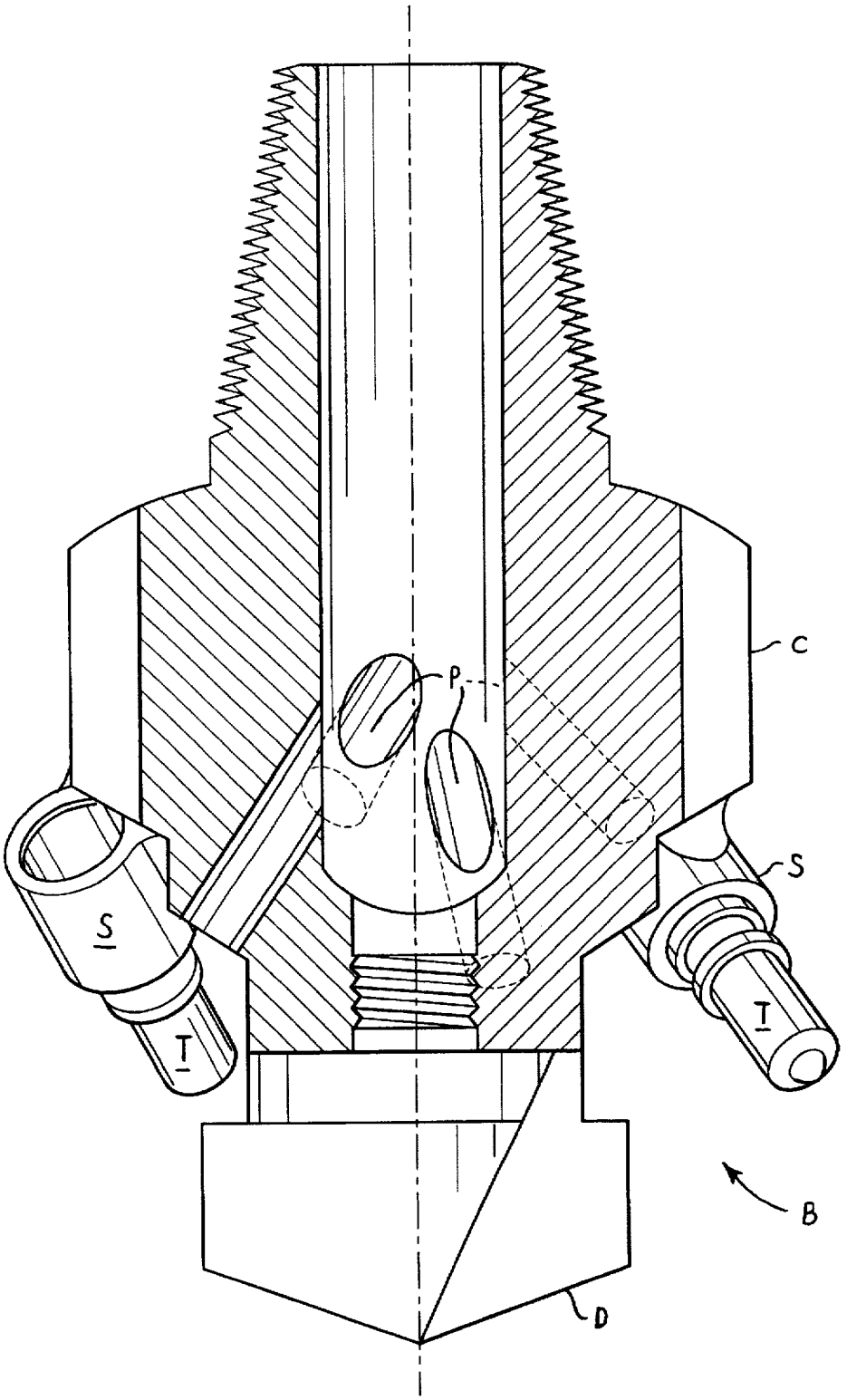
Fig. 7 (PRIOR ART)
FIG. 7 is a side elevation view in section of the prior art claw bit of FIGS. 5 and 6, showing the relatively small passages from the working end of the bit to the hollow shank of the bit, and other differences from the present mining bit embodiments.

The advantages of the present drill bit embodiments 10 and 100 will be apparent when compared to a claw bit B of the prior art, as shown in FIGS. 5 through 7. The claw bit B includes a generally hollow central body C, but the body C is closed at its forwardmost end F by a solid pilot drill bit D. Such a pilot drill D might be advantageous in certain conditions to assist the bit B in starting or centering a hole, but any bit which is used on a relatively rigid shaft will be held in alignment by the shaft, with the pilot drill bit D accomplishing little or nothing towards breaking up or cutting hard mineral or softer earthen materials. Also, it will be seen that the cutting tooth sockets S and their respective cutting teeth T are disposed relatively close to the central body C, with little space provided between the cutting teeth T and central body C. As all of the cuttings and debris must pass around the outside of the central body C, this limits the quantity of material which may pass by the bit, and thus limits drilling speed.

Also, the prior art bit B of FIGS. 5 through 7 includes only six cutting teeth T, rather than the nine or more provided by the mining bit embodiments 10 and 100. Each of the teeth T are placed at essentially the same distance or radius from the center of the bit B, thus limiting the cutting action provided by the teeth T and requiring the solid central pilot drill D to provide a significant amount of the cutting action. Also, in order to provide even six teeth T, as shown in FIGS. 5 through 7, the prior art claw bit B must cluster these teeth T and their respective sockets S so that they are arranged in two tiers or levels, as shown clearly in FIG. 5. The lowermost or forwardmost level thus provides practically all of the cutting work using only three teeth, with the upper or rearwardly disposed teeth accomplishing little.

The above described prior art claw drill bit of FIGS. 5 through 7 is better adapted for the drilling of relatively deep wells, where it may be used with relatively flexible drill strings and the pilot drill D reduces any tendency for the bit to wander. Coolant and/or lubricant is delivered down the drill string and through the relatively small passages P which extend diagonally from the forwardmost end of the hollow central passage in the central body C, as shown in FIG. 7. However, the small passages P of such a claw bit B quickly tend to clog with clay and/or other debris, and the periphery about the central body C provides only limited space for debris removal. On the other hand, the present mining bit 10 or 100 is well adapted for such use, providing good clearance for the removal of debris from a working hole.

The present inventor has performed tests comparing an eleven inch diameter claw bit, generally resembling the prior art claw bit B shown in FIGS. 5 through 7, with an eleven inch diameter test model of the three wing bit 100 of the present invention. A series of ten, 55 foot deep holes were drilled with each bit. The material encountered was generally 42 feet of hard clay, and 13 feet of sand. (Exceptions are noted below.) A Model 399 drill was used to drive each of the bits, using a feed pump pressure of 1500 pounds for the prior art claw bit and 2000 pounds for the present three wing bit. (Lower pressure was used with the prior art bit due to structural limitations of the bit.) A drilling speed of 85 to 90 rpm was used. A table showing the drilling times required for each bit to reach the 55 foot hole depth, is provided below:

TABLE I

DRILLING TIME COMPARISON BETWEEN PRIOR ART BIT AND PRESENT BIT

| HOLE NO. | PRESENT THREE WING BIT | PRIOR ART CLAW BIT |
|---|---|---|
| 1. | 2 minutes 25 seconds | 5 minutes 15 seconds |
| 2. | 2 minutes 20 seconds | 5 minutes 15 seconds |
| 3. | 2 minutes 20 seconds | 5 minutes 13 seconds |
| 4. | 3 minutes 30 seconds\1 | 5 minutes 50 seconds\2 |
| 5. | 3 minutes 20 seconds\1 | 5 minutes 35 seconds |
| 6. | 4 minutes 30 seconds\3 | 5 minutes 15 seconds |
| 7. | 3 minutes 50 seconds\3 | 5 minutes 00 seconds |
| 8. | 4 minutes 00 seconds\3 | 5 minutes 30 seconds |
| 9. | 2 minutes 30 seconds\4 | 7 minutes 30 seconds\4 |
| 10. | 2 minutes 35 seconds | 5 minutes 20 seconds |

NOTES:
1. Approx. 2.5 ft. of rock hit with present bit in holes 4 and 5.
2. Hit rock with prior art claw bit in hole #4.
3. Approx. 2 ft. of rock hit with present bit in holes 6, 7, & 8.
4. Approx. 1 ft. of rock hit with each bit in holes 9.

The above tests clearly show that the present winged bit is considerably faster than the prior art claw bit of the same diameter. In addition to the freedom from clogging that the present bit provides, it is capable of achieving much longer wear than conventional claw bits, due to the greater number of hardened cutting teeth on the bit compared to a conventional claw bit of equal diameter, as well as other factors. Conventional claw bits have a life of about 15,000 to 20,000 feet of drilling, and rarely reach 30,000 feet. The present winged bit easily achieves 40,000 to 50,000 feet, and has reached 70,000 feet before wearing out. Also, the present bit is capable of using considerably more pulldown weight (working force on the drill bit) than prior art claw bits. The present three winged bit has been tested using 29,000 pounds pulldown weight as a standard, which is the maximum used for claw bits drilling rock; conventional claw bits are normally limited to 18,000 pounds. The present bit has been tested using pulldown forces as high as 50,000 pounds when drilling rock.

In summary, the present winged mining bit embodiments will be seen to provide a great advance over mining drill bits of the prior art. The present bit is easier to manufacture due to the use of stock materials, wears considerably longer, and drills with much greater speed than conventional claw bits. Thus, the present bit provides a significant advance in the mining and drilling industry.

It is to be understood that the present invention is not limited to the sole embodiments described above, but encompasses any and all embodiments within the scope of the following claims.

I claim:

1. A rotary mining bit, comprising:

a hollow central body having a central axis and a single large diameter axial passage therethrough, with said central body further having a forward truncated conical working end portion and an opposite rearward attachment end portion adapted for the removable attachment of said bit to a cooperating drill stem;

a plurality of flat, planar wings extending radially from said central body and evenly spaced therearound, with each of said wings being parallel to and coplanar with said central axis of said body and having a forward face in the direction of rotation of said rotary mining bit;

each of said wings including a forward portion disposed forwardly of said working end of said central body, with said forward portion of each of said wings extending inwardly to said central axis of said central body and being affixed to each other said forward portion of said wings at a wing juncture along said central axis of said body;

each of said wings further having a leading edge, with each said leading edge and said wing juncture defining a bit apex, and;

each said leading edge including a plurality of spaced apart cutting tooth sockets affixed therealong, with each of said sockets having a cutting tooth removably affixed therein and coaxial therewith.

2. The rotary mining bit according to claim 1, wherein:

said leading edge of each of said wings has a leading edge taper extending outwardly and rearwardly from said bit apex.

3. The rotary mining bit according to claim 1, wherein:

each of said wings has a lateral edge, with said lateral edge and said leading edge of each of said wings intersecting to define a gauge point for each of said wings, and;

each said lateral edge of each of said wings has a lateral taper extending inwardly toward said central axis of said body and rearwardly from said gauge point.

4. The rotary mining bit according to claim 1, wherein:

each of said wings has a lateral edge, with said lateral edge and said leading edge of each of said wings intersecting to define a gauge point for each of said wings;

each said lateral edge each of said wings has a lateral taper extending inwardly toward said central axis of said body and rearwardly from said gauge point, and;

each of said wings includes an outermost gauge point cutting tooth socket at said gauge point thereof, with each said gauge point cutting tooth socket and said cutting tooth disposed therein being angled outwardly from said lateral edge of a respective one of said wings.

5. The rotary mining bit according to claim 1, wherein:

each of said cutting tooth sockets and each said cutting tooth is angled downwardly and forwardly from said forward face of each of said wings.

6. The rotary mining bit according to claim 1, wherein:

said leading edge of each of said wings includes at least one intermediate cutting tooth socket and cutting tooth, with each said intermediate cutting tooth socket and cutting tooth therein being positioned at a different radial distance from said central axis of said body to define a different cutting diameter for said cutting tooth within each said intermediate cutting tooth socket.

7. The rotary mining bit according to claim 1, wherein:

each of said cutting tooth sockets includes a rear face and a cutting tooth passage extending completely therethrough, with each said cutting tooth being tightly affixed within a respective one of said cutting tooth sockets and with said each of said sockets providing for the removal of a respective said cutting tooth therefrom by driving said respective said cutting tooth from said one of said sockets.

8. The rotary mining bit according to claim 1, wherein:

said central body has a major diameter, and said central passage of said central body has a diameter of at least one third of said major diameter of said central body.

9. The rotary mining bit according to claim 1, wherein:

said mining bit includes three said wings, with each of said wings including at least three cutting tooth sockets thereon.

10. The rotary mining bit according to claim 1, wherein:

said mining bit includes four said wings, with each of said wings including at least three cutting tooth sockets thereon.

11. A rotary mining bit, comprising:

a hollow central body having a central axis and a single large diameter axial passage therethrough, with said central body further having a forward truncated conical working end portion and an opposite rearward attachment end portion adapted for the removable attachment of said bit to a cooperating drill stem;

a plurality of flat, planar wings extending radially from said central body and evenly spaced therearound, with each of said wings being parallel to and coplanar with said central axis of said body and having a forward face in the direction of rotation of said bit;

each of said wings including a forward portion disposed forwardly of said working end of said central body, with said forward portion of each of said wings extending inwardly to said central axis of said central body and being affixed to each other said forward portion of said wings at a wing juncture along said central axis of said body;

said forward portions of two said adjacent wings defining an axial passage extension channel therebetween communicating with said single axial passage of said hollow central body, and providing for the passage of material through said mining bit along each said channel and through said axial passage of said central body;

each of said wings further having a leading edge, with each said leading edge and said wing juncture defining a bit apex, and;

each said leading edge including a plurality of spaced apart cutting tooth sockets affixed therealong, with each of said sockets having a cutting tooth removably affixed therein and coaxial therewith.

12. The rotary mining bit according to claim 11, wherein:

said leading edge of each of said wings has a leading edge taper extending outwardly and rearwardly from said bit apex.

13. The rotary mining bit according to claim 11, wherein:

each of said wings has a lateral edge, with said lateral edge and said leading edge of each of said wings intersecting to define a gauge point for each of said wings, and;

each said lateral edge of each of said wings has a lateral taper extending inwardly toward said central axis of said body and rearwardly from said gauge point.

14. The rotary mining bit according to claim 11, wherein:

each of said wings has a lateral edge, with said lateral edge and said leading edge of each of said wings intersecting to define a gauge point for each of said wings;

each said lateral edge each of said wings has a lateral taper extending inwardly toward said central axis of said body and rearwardly from said gauge point, and;

each of said wings includes an outermost gauge point cutting tooth socket at said gauge point thereof, with each said gauge point cutting tooth socket and said cutting tooth disposed therein being angled outwardly from said lateral edge of a respective one of said wings.

15. The rotary mining bit according to claim 11, wherein:

each of said cutting tooth sockets and each said cutting tooth is angled downwardly and forwardly from said forward face of each of said wings.

16. The rotary mining bit according to claim 11, wherein:

said leading edge of each of said wings includes at least one intermediate cutting tooth socket and cutting tooth, with each said intermediate cutting tooth socket and cutting tooth therein being positioned at a different radial distance from said central axis of said body to define a different cutting diameter for said cutting tooth within each said intermediate cutting tooth socket.

17. The rotary mining bit according to claim 11, wherein:

each of said cutting tooth sockets includes a rear face and a cutting tooth passage extending completely therethrough, with each said cutting tooth being tightly affixed within a respective one of said cutting tooth sockets and with said each of said sockets providing for the removal of a respective said cutting tooth therefrom by driving said respective said cutting tooth from said one of said sockets.

18. The rotary mining bit according to claim 11, wherein:

said central body has a major diameter, and said central passage of said central body has a diameter of at least one third of said major diameter of said central body.

19. The rotary mining bit according to claim 11, wherein:

said mining bit includes three said wings, with each of said wings including at least three cutting tooth sockets thereon.

20. The rotary mining bit according to claim 11, wherein:

said mining bit includes four said wings, with each of said wings including at least three cutting tooth sockets thereon.

* * * * *